US005208988A

United States Patent [19]

Edelman

[11] Patent Number: 5,208,988

[45] Date of Patent: May 11, 1993

[54] CUFF CUTTER APPARATUS

[76] Inventor: Herman Edelman, 8811 Canoga Ave. #414, Canoga Park, Calif. 91304

[21] Appl. No.: 790,822

[22] Filed: Nov. 12, 1991

[51] Int. Cl.[5] ..... B43L 13/00

[52] U.S. Cl. ..... 33/32.3; 33/2 H

[58] Field of Search ..... 33/2 R, 2 H, 562, 32.1, 33/32.2, 32.3, 41.1

[56] References Cited

U.S. PATENT DOCUMENTS

| | | | |
|---|---|---|---|
| 1,106,224 | 8/1914 | Kizer | 33/32.3 |
| 1,560,417 | 11/1925 | Dreschler | 33/2 H |
| 2,624,945 | 1/1953 | Mena | 33/32.1 X |
| 2,711,587 | 6/1955 | Branman | 33/2 H |
| 3,526,038 | 9/1970 | Katz | 33/32.2 X |

*Primary Examiner*—Harry N. Haroian
*Attorney, Agent, or Firm*—Leon Gilden

[57] ABSTRACT

A template structure defined as a template plate, including a front edge, a rear edge, and intermediate first and second slots arranged in a Parallel relationship are defined by the template plate. The first slot includes a first slot rear edge spaced from and parallel a first slot front edge, with the second slot including a second slot rear edge spaced from and parallel the second slot front edge. The first slot is positioned adjacent the rear edge, with the second slot positioned adjacent the front edge of the organization. The front edge permits severing of a pants leg therealong, wherein the front edge is spaced from the second slot rear edge a first length, wherein a respective second length is defined between the second slot rear edge and the first slot rear edge, with a third length defined between the first slot rear edge and the rear edge of the template plate. The second and third lengths are equal and substantially equal a cuff height, with the first length greater than the second and third lengths to provide for excess material by tailors in an overfolding seam construction of the cuff. Modifications of the invention include various cutter and marking structure to enhance adaptability and repetity in use of the organization.

3 Claims, 4 Drawing Sheets

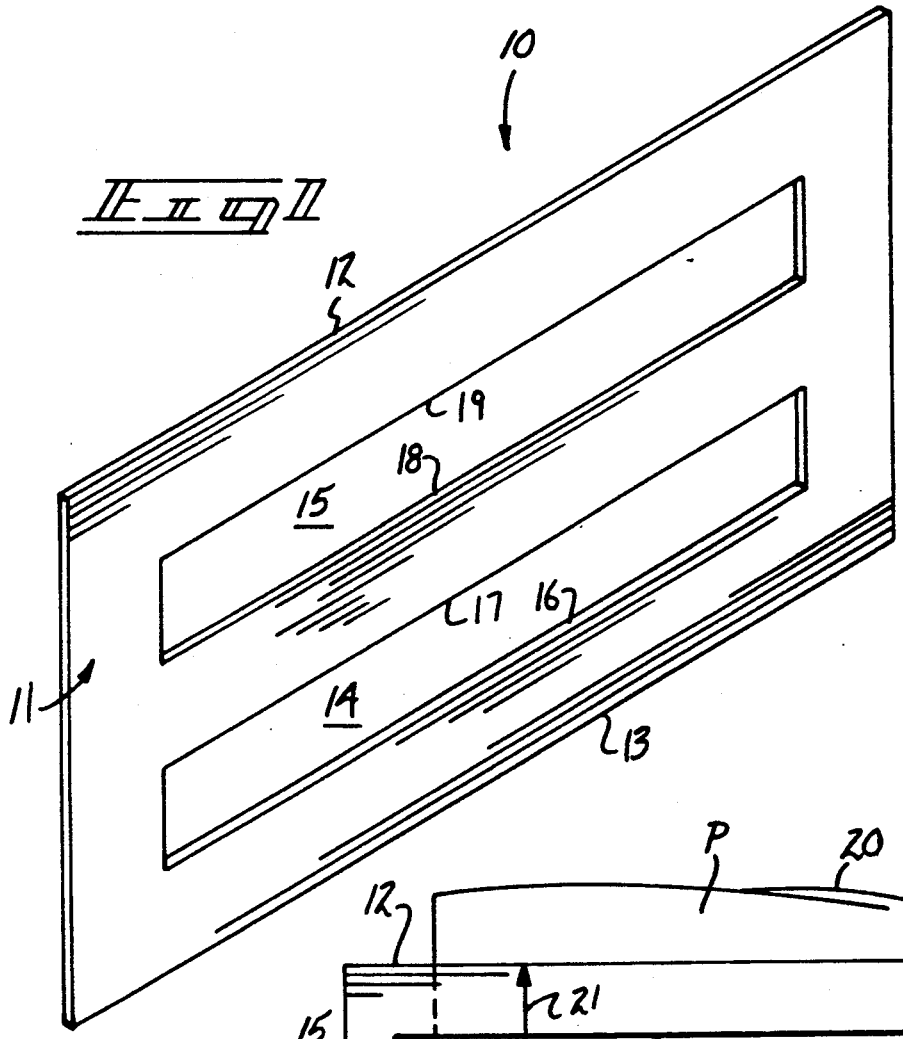
FIG. 1
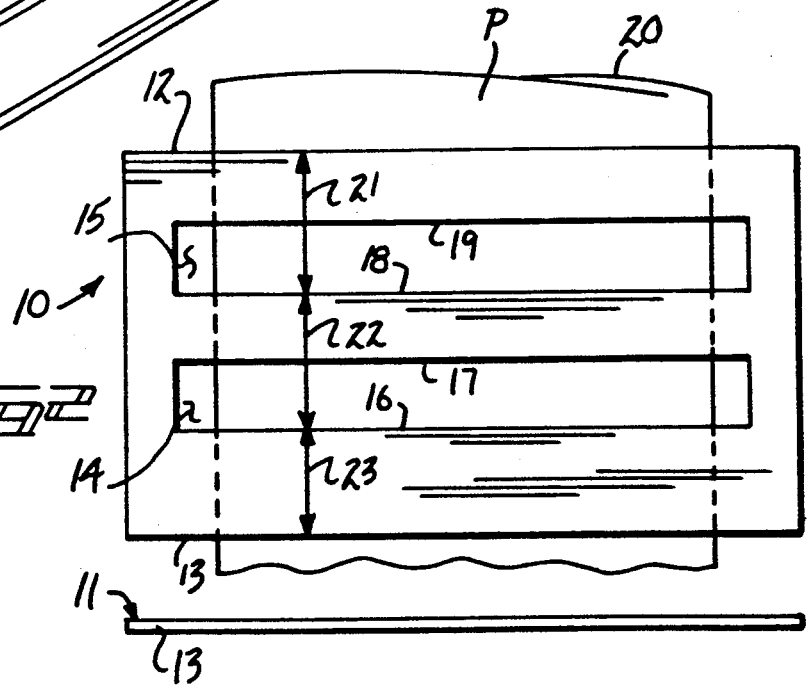
FIG. 2
FIG. 3

10a
31
28
27
26
35
34
33
32
25
12
24
29
30
19
18
17
16
13
5
5

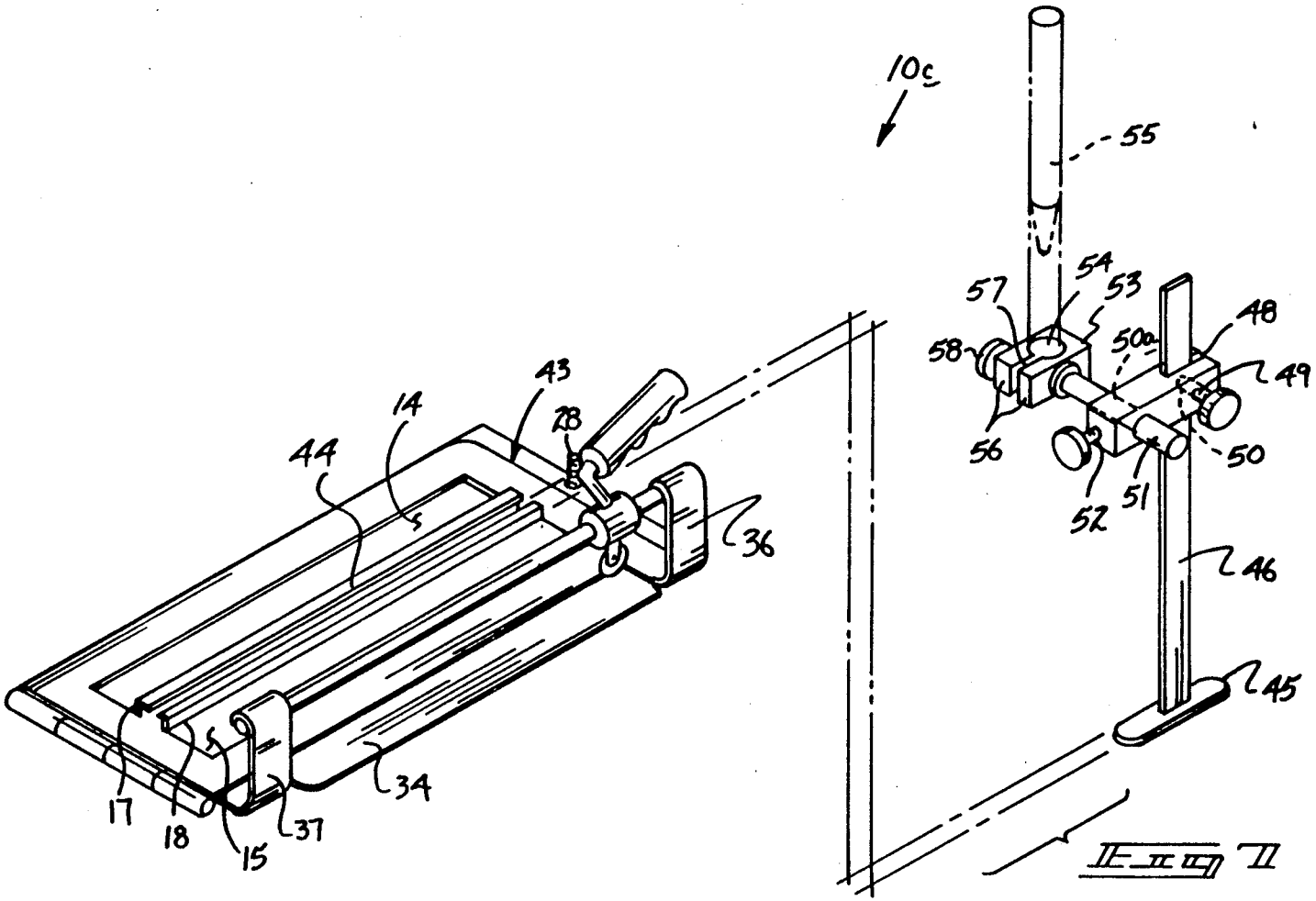
10c
55
54
53
50a
48
49
50
51
52
46
45
57
58
56
II-II
36
43
28
14
44
34
37
15
18
17

CUFF CUTTER APPARATUS

BACKGROUND OF THE INVENTION

1. Field of the Invention

The field of invention relates to cuff forming apparatus, and more particularly pertains to a new and improved cuff cutter apparatus wherein the same provides a template for the marking and severing of various portions of a pants leg to effect forming of a subsequent cuff member relative to the pants workpiece.

2. Description of the Prior Art

In the absence of automated cuff forming apparatus, tailors utilize a time consuming procedure to mark various positions relative to a lower terminal end of a pants leg for the subsequent forming of a cuff thereon. The instant invention attempts to overcome deficiencies of the prior art for use by individual tailors by providing a template structure and cutting arrangement to provide for the cutting, marking, and subsequent interfolding of a pants leg.

Prior art automated cuff forming apparatus is exemplified in the U.S. Pat. Nos. 3,448,462 and 4,592,295 illustrating prior art assembly line techniques in cuff forming, but as is understood, such apparatus is not available to individual tailors.

Accordingly, it may be appreciated that there continues to be a need for a new and improved cuff cutter apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cuff forming apparatus now present in the prior art, the present invention provides a cuff cutter apparatus wherein the same provides for a template structure for the marking and cutting of a pants leg to permit interfolding thereof for subsequent forming of a cuff member. As such, the general purpose of the present invention, which will be described subsequently in greater detail, is to provide a new and improved cuff cutter apparatus which has all the advantages of the prior art cuff forming apparatus and none of the disadvantages.

To attain this, the present invention provides a template structure defined as a template plate, including a front edge, a rear edge, and intermediate first and second slots arranged in a parallel relationship defined by the template plate. The first slot includes a first slot rear edge spaced from and parallel a first slot front edge, with the second slot including a second slot rear edge spaced from and parallel the second slot front edge. The first slot is positioned adjacent the rear edge, with the second slot positioned adjacent the front edge of the organization. The front edge permits severing of a pants leg therealong, wherein the front edge is spaced from the second slot rear edge a first length, wherein a respective second length is defined between the second slot rear edge and the first slot rear edge, with a third length defined between the first slot rear edge and the rear edge of the template plate. The second and third lengths are equal and substantially equal a cuff height, with the first length greater than the second and third lengths to provide for excess material by tailors in an overfolding seam construction of the cuff. Modifications of the invention include various cutter and marking structure to enhance adaptability and repetity in use of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application. which is measured by the claims, nor is it intended to be limiting as to the scope of the invention in any way.

It is therefore an object of the present invention to provide a new and improved cuff cutter apparatus which has all the advantages of the prior art cuff forming apparatus and none of the disadvantages.

It is another object of the present invention to provide a new and improved cuff cutter apparatus which may be easily and efficiently manufactured and marketed.

It is a further object of the present invention to provide a new and improved cuff cutter apparatus which is of a durable and reliable construction.

An even further object of the present invention is to provide a new and improved cuff cutter apparatus which is susceptible of a low cost of manufacture with regard to both materials and labor, and which accordingly is then susceptible of low prices of sale to the consuming public, thereby making such cuff cutter apparatus economically available to the buying public.

Still yet another object of the present invention is to provide a new and improved cuff cutter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic top view of the template structure of the invention.

FIG. 6 is an isometric illustration of a further modified aspect of the invention.

FIG. 7 is an isometric illustration of a yet further modified aspect of the invention.

DESCRIPTION OF THE PREFERRED EMBODIMENT

Figures 4, 5:
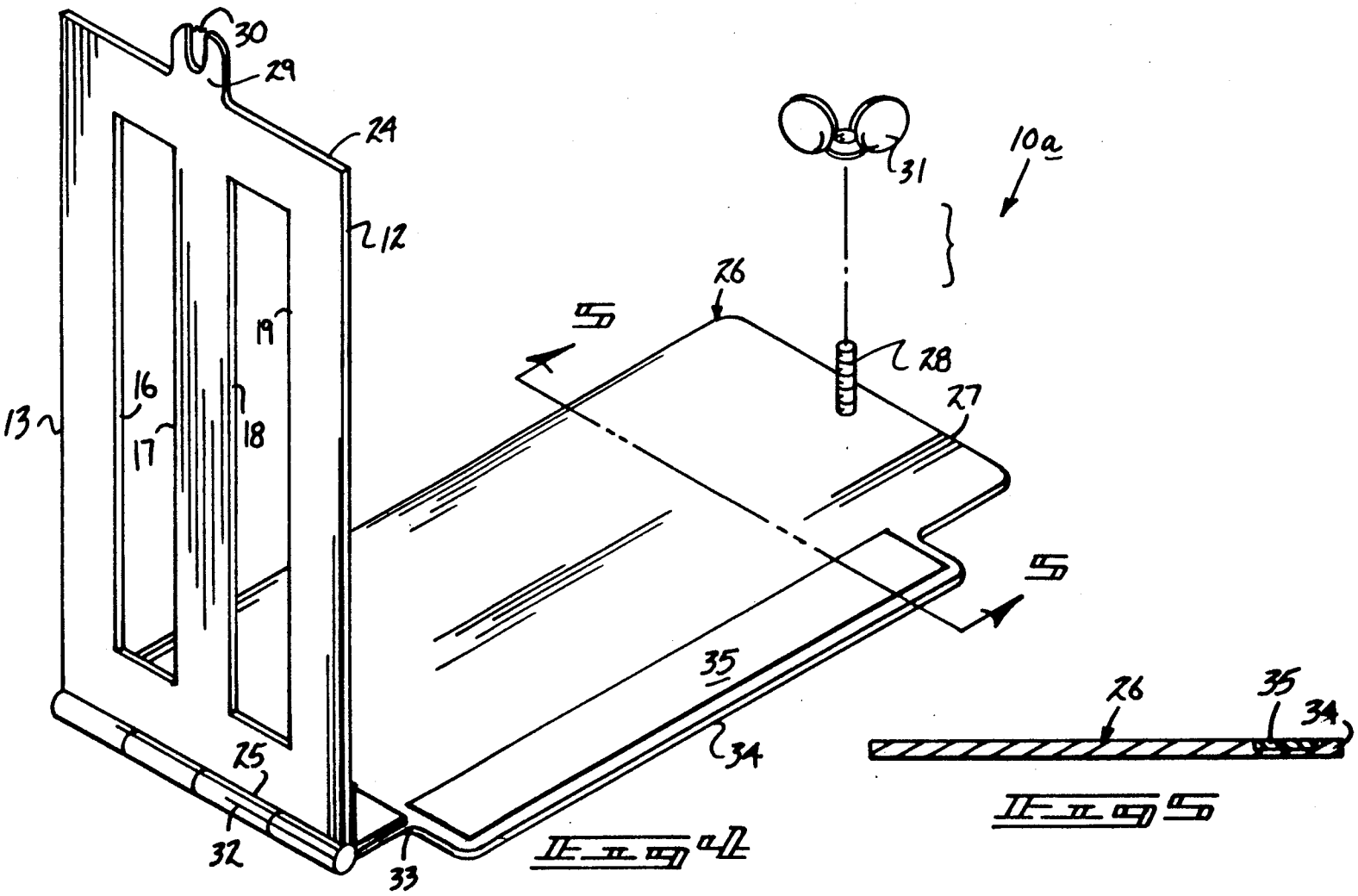
FIG. 4 is an isometric illustration of a modification of the invention.
FIG. 5 is an orthographic view, taken along the lines 5—5 of FIG. 4 in the direction indicated by the arrows.
Figure 3:
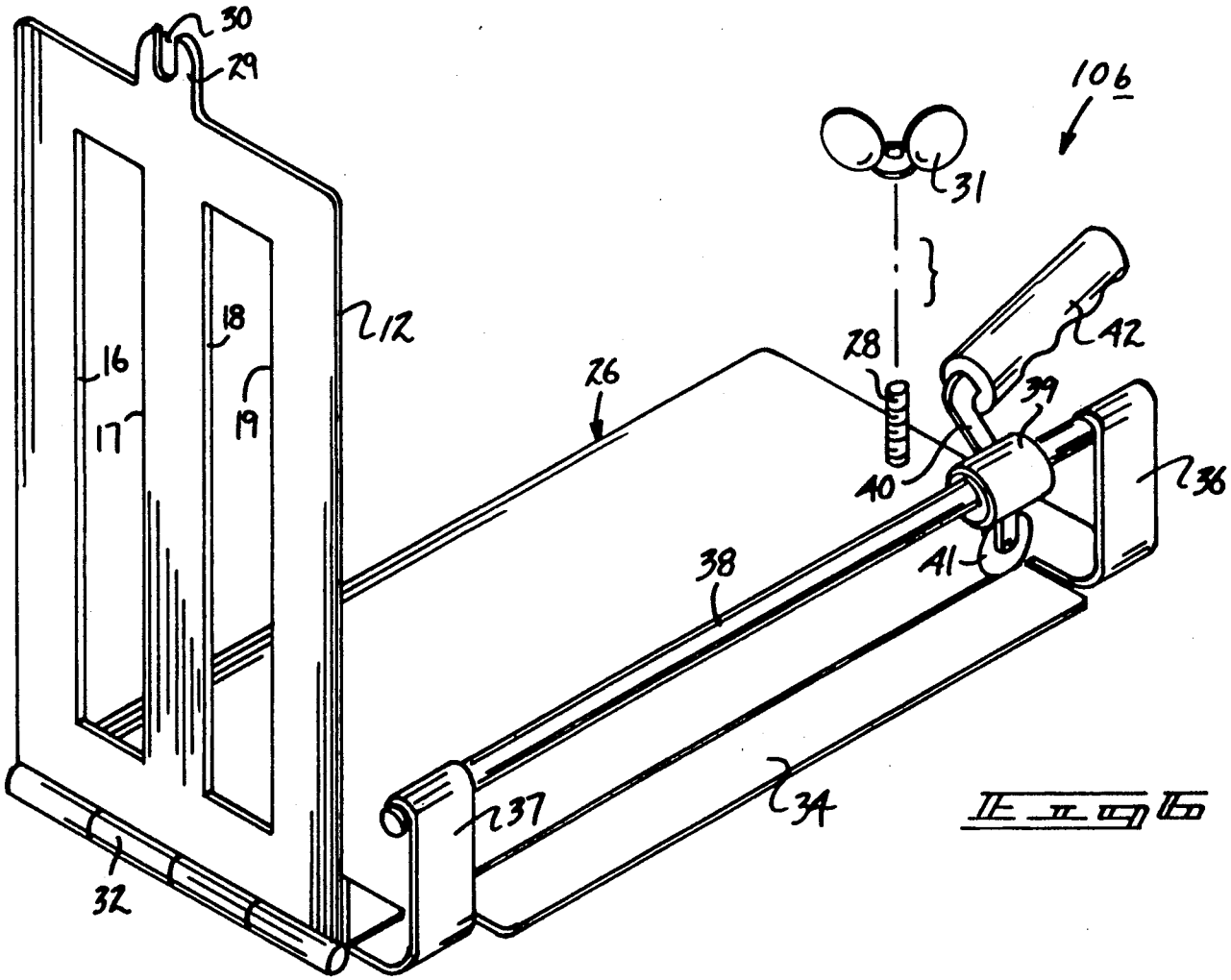
FIG. 3 is an orthographic front end view of the invention.

With reference now to the drawings, and in particular to FIGS. 1 to 7 thereof, a new and improved cuff cutter apparatus embodying the principles and concepts of the present invention and generally designated by the reference numerals 10, 10*a*, 10*b*, and 10*c* will be described.

More specifically, the cuff cutter apparatus 10 of the instant invention essentially comprises a planar template plate 11, including a front edge 12 spaced from, coextensive with, and parallel to a rear edge 13 that is arranged for coincidence with a marking length on a pants leg "P" The marking is typically affixed by a tailor when measuring pants or fitting upon an individual. A first slot 14 positioned adjacent the rear edge 13 is arranged parallel to the rear edge and is spaced from, parallel, and coextensive with a second slot 15 that is positioned adjacent the front edge 12 between the front edge 12 and the first slot 14. The first slot 14 includes a first slot rear edge 16 adjacent the rear edge 13 spaced from a first slot front edge 17. The second slot 15 includes a second slot rear edge 18 adjacent the first slot front edge 17 and spaced from a second slot front edge 19 that is in turn adjacent the front edge 12 in a spaced relationship. A first length 21 is defined between the front edge 12 and the second slot rear edge 18. A second length 22 is defined between the second slot rear edge 18 and a first slot rear edge 16 and finally, a third length 23 is defined between the first slot rear edge 16 and the template plate rear edge 13. The second length 22 is equal to the third length 23, wherein the first length 21 is of a further length greater than the second length and the third length, wherein the pants leg leading edge 20 is positioned such that the front edge 12 defines a cut-off line and the pants leg "P" are severed along that line, with the pants leg between the cut-off line and the pants leg leading edge 20 discarded. The first slot front edge 17 and the second slot front edge 19 become fold lines, whereas the use of the first length of material between the front edge 12 and the second slot rear edge 18 provides for an extra bit of material to be overfolded in a manner to afford portion for seaming for use by tailors, in a manner known in the prior art. Accordingly, the second and third lengths 22 and 23 are substantially equal to the cuff length, where it is understood that the second and third lengths and formation of the template structure may be varied to provide for cuff lengths such as one and one-fourths inches, one and one-half inches, and one and three-quarters inches, wherein typically, the first length 21 exceeds the second and third lengths by substantially one and one-fourth inches, wherein for example should the cuff length or height be one and three-fourth inches, the first length 21 would be two inches.

The apparatus 10*a*, as illustrated in the FIGS. 4 and 5, includes the template 11 formed with a template plate first side edge 24, to include a first side edge bifurcated projection 29 defining a projection slot 30. A template plate second side edge 25 is spaced from and parallel the template plate first side edge, wherein the first and second side edges are orthogonally oriented relative to the front and rear edges 12 and 13. A clamp plate 26 is positioned below a template plate 24 and includes a clamp plate first side edge 27, including a threaded boss 28 orthogonally mounted to the clamp plate 26 adjacent the first side edge 27 to be received through the template plate first side edge projection slot 30, wherein a clamp fastener 31 is arranged for capturing and securing the template plate 11 in contiguous communication to the clamp plate 26 upon positioning of a pants leg therebetween. A hinge 32 mounted to the template plate second side edge 25 and the clamp plate second side edge 33 permits a pivoted mounting of the template plate relative to the clamp plate. The clamp plate includes a clamp plate front edge 34 spaced from and beyond the template plate front edge 12 mounting a polymeric insert anvil strip 35 to accommodate a cutter directed thereacross in separating a pants leg forward portion against the front edge 12.

The modified aspect of the invention as set forth in the FIG. 6 indicated as the apparatus 10*b* further includes an addition to the structure of the FIG. 5, a respective first and second support leg 36 and 37 projecting upwardly and orthogonally relative to the clamp plate 26 on opposed sides of the polymeric insert anvil strip 35 adjacent to and parallel the front edge 12 of the template plate 11 when in a secured orientation relative to the clamp plate 26. The first and second support legs 36 and 37 fixedly mount a cutter support rod 38 therebetween as the support rod 38 extends above and parallel the polymeric anvil strip 35 and includes a cutter mount 39 formed with a cylindrical bore to slidingly receive the support rod 38. A cutter support leg 40 transversely oriented relative to the support rod 38 includes a cutter 41 mounted at a lower distal end of the support leg 40 aligned with the front edge 12 of the template 11 when in the lowered position. A cutter handle 42 is mounted to an upper distal end of the support leg 40 to permit ease of projection of the rotary cutter 41 along the front edge 12 to permit ease of severing of the forward portion of the pants leg "P".

The apparatus 10*c*, as illustrated in FIG. 7, includes the construction of the FIGS. 1–6 to further include a modified template plate 43 including a guide track 44 extending above a top surface of the modified template plate 43 between the first and second slots 14 and 15. A guide track foot 45 is slidingly mounted within the guide track 44 that in turn is coextensive with the first and second slots 14 and 15. The track foot 45 includes an extension leg 46 extending orthogonally relative to the foot above the template plate 43, including an adjustment block 47 slidably mounted along the extension leg 46. The adjustment block 47 includes a block slot 48 receiving the extension leg 46 therewithin, wherein use of a first clamp member 49 received within a clamp member bore 50 that is orthogonally intersecting the block slot 48 is arranged for abutment and engagement with the extension leg 46 to arrest positioning of the adjustment block 47 along the extension leg 46. A second clamp member 52 intersects clamp bore 50*a* that slidably receives a slide rod 51 therethrough. A second clamp member 52 threadedly received and orthogonally intersecting the second clamp bore 50*a* is arranged for arresting the slide rod 51 that is orthogonally oriented relative to the extension leg 46 extending laterally thereof fixedly mounting a mounting block 53 at a forward distal end thereof. The mounting block 53 includes a mounting block bore 54 oriented parallel to and spaced from the extension leg 46 to receive an elongate marking member 55 therewithin. The mounting block includes a mounting block bifurcated leg portion 56 defining a mounting block slot 57 in communication with the mounting block bore 54, wherein a mounting block clamp member 58 directed through the mounting block slot 57 draws the bifurcated legs 56 towards one another to enhance clamping of the marking member 55 within the mounting block bore 54. In this manner, the elongate marking member 55 may be positioned above the slots 14 and 15 in a desired portion thereof to provide for adjustable marking within the slots utilizing either the rear or forward edges of each slot or any portion therebetween to provide for a linearly aligned marking line permitting subsequent folding of the cuff structure of a pants leg "P".

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cuff cutter apparatus for marking a pants leg, wherein the apparatus comprises, a template plate, the template plate including a front edge spaced from, coextensive with, and parallel to a rear edge, and the template plate including a first side edge spaced from and parallel a second side edge, wherein the first side edge and the second side edge are orthogonally oriented relative to the front edge and the rear edge, and a first enclosed slot adjacent the rear edge and parallel the rear edge defined by a predetermined length, and a second slot positioned between the first slot and the front edge parallel to the first slot and defined by a second slot length equal to the predetermined length, and the first slot including a first slot rear edge spaced from a first slot front edge, and the second slot including a second slot rear edge spaced from and parallel a second slot front edge, and the front edge is spaced from the second slot rear edge a predetermined first length, and the second slot rear edge is spaced from the first slot rear edge a predetermined second length, and the first slot rear edge is spaced from the template plate rear edge a predetermined third length, wherein the predetermined second length is equal to the predetermined third length and the predetermined first length is greater than the predetermined second length, and including a clamp plate, the clamp plate including a clamp plate first side edge, and the clamp plate further including a threaded boss fixedly and orthogonally mounted to the clamp plate projecting upwardly thereof adjacent the first side edge, and the template plate first side edge including a bifurcated projection defining a projection slot to receive the threaded boss therethrough, and the clamp plate including a clamp plate second side edge, the clamp plate second side edge including a hinge mounted to the clamp plate second side edge and mounted to the template plate second side edge to permit pivotment of the template plate relative to the clamp plate, and the clamp plate including a clamp plate front edge spaced beyond the template plate front edge, and further including a polymeric insert anvil strip mounted within the clamp plate extending from the template front edge to substantially clamp the clamp plate front edge when the bifurcated projection receives a threaded boss therethrough, and the threaded boss includes a clamp fastener for securement to the threaded boss to secure the template plate to the clamp plate.

2. An apparatus as set forth in claim 3 wherein the clamp plate includes a first support leg and a second support leg mounted adjacent opposed ends of the polymeric insert strip extending upwardly of the clamp plate adjacent the template plate front edge, wherein the first support leg and the second support leg mount a cutter support rod orthogonally therebetween, and the utter support rod is spaced above and parallel the polymeric insert anvil strip, and a cutter mount including a cutter mount cylindrical bore slidably mounted to receive the support rod therethrough, the cutter mount including a cutter support leg fixedly mounted to the cutter mount transversely oriented relative to the support rod, wherein a lower distal end of the support rod includes a rotary cutter mounted thereon for engagement with the polymeric insert anvil strip, and an upper distal end of the cutter support leg includes a cutter handle to permit manual transverse of the cutter mount rotary cutter along the anvil strip adjacent the template plate front edge.

3. An apparatus as set forth in claim 2 wherein the template plate includes a guide track extending upwardly of the template plate between the first slot and the second slot coextensive with the first slot and the second slot, and a guide track foot slidably guided within the guide track, the guide track foot including an extension leg extending upwardly relative to the guide track foot, the extension leg including an adjustment block slidably mounted relative to the extension leg and including lock means for locking the adjustment block relative to the extension leg, and the adjustment block including an adjustment block slide rod bore directed through the adjustment block, and a slide rod slidably received through the slide rod bore, the slide rod orthogonally oriented relative to the extension leg, and the extension leg orthogonally oriented relative to the template plate, and means for clamping the slide rod relative to the slide rod bore, and a mounting block fixedly mounted to a distal end of the slide rod, the mounting block including a mounting block bore, the mounting block bore oriented parallel to and spaced from the extension leg, and the mounting block bore including a marking member directed through the mounting block bore for reception within one of said first and second slots.

* * * * *